United States Patent [19]

Grünewald et al.

[11] Patent Number: 4,580,482

[45] Date of Patent: Apr. 8, 1986

[54] AMMUNITION-STOWAGE SYSTEM IN AN AMMUNITION BUNKER WITH SIDE WALLS THAT TAPER UPWARD

[75] Inventors: Peter Grünewald, Fuldabrück; Heinz-Jürgen Schlömer, Vellmar, both of Fed. Rep. of Germany

[73] Assignee: Wegmann & Co. GmbH, Kassel, Fed. Rep. of Germany

[21] Appl. No.: 560,024

[22] Filed: Dec. 9, 1983

[51] Int. Cl.[4] ..... F42B 39/00

[52] U.S. Cl. ..... 89/34; 206/3

[58] Field of Search ..... 89/34, 36 K, 45, 40.07; 206/3

[56] References Cited

U.S. PATENT DOCUMENTS

| | | | |
|---|---|---|---|
| 1,383,242 | 6/1921 | Schneider | 89/34 |
| 1,429,370 | 9/1922 | Putnam | 89/34 |
| 2,594,198 | 4/1952 | Motley | 89/36 K |
| 2,951,422 | 9/1960 | Bobkowski | 89/36 K |
| 3,322,036 | 5/1967 | Jäfwert | 89/45 |
| 3,818,794 | 6/1974 | Mayer et al. | 89/45 |

*Primary Examiner*—Stephen C. Bentley
*Assistant Examiner*—John S. Maples
*Attorney, Agent, or Firm*—Sprung Horn Kramer & Woods

[57] ABSTRACT

In the turrets of tanks and other battle systems the ammunition is supposed to be stored in the ammunition bunker of the turret itself, in ammunition-stowage systems. Since tank turrets taper upward as a rule whereas the space available for storing ammunition should be completely exploited, the ammunition-stowage system as a whole can not be installed in the turret from above. To allow the ammunition-stowage system to be installed in the turret, the system is divided into three or four storage racks that can be installed individually in the turret from above. The outer storage racks widen outward in conformity with the slope of the side walls of the turret and have inwardly vertical demarcations, with the intermediate storage rack or intermediate storage racks having vertical demarcations or walls.

3 Claims, 4 Drawing Figures

AMMUNITION-STOWAGE SYSTEM IN AN AMMUNITION BUNKER WITH SIDE WALLS THAT TAPER UPWARD

BACKGROUND OF THE INVENTION

In the turrets of tanks and other battle systems at least some of the ammunition is stored in ammunition bunkers in the turret itself, specifically in such a way that the shells are oriented with their points to the rear and can be removed through a door from the front with the bases of the shells toward the front. Since tank turrets taper upwardly as a rule whereas the space available for storing ammunition should be completely exploited, it is difficult to install the stowage system that is intended to accept the ammunition into the turret from above. It is even more difficult when it is necessary for the ammunition bunker to be divided by a central armored wall to prevent any deflagrating ammunition from penetrating to the other half.

SUMMARY OF THE INVENTION

The object of installing an ammunition-stowage system that holds as much ammunition as possible into a turret that tapers upward is attained in accordance with the invention in that the storage tubes are combined into several storage racks that are installed separated from each other by vertical joints or by walls and can be screwed together once they have been installed in the turret. The outer storage racks, those that are nearest the wall of the turret, widen outwardly, in conformity with the slope of the side walls, and have inwardly vertical demarcations that can be dismounted along with them. The storage rack in the middle has vertical and dismountable, not welded to the turret housing, that is, demarcations or walls on both sides. If the ammunition bunker is divided into two compartments by a welded-in central armored wall, the bunker will be divided into four storage racks with the outer rack again widening outward in conformity with the slope of the side walls and having inwardly vertical, dismountable demarcations, whereas the two racks in the middle will have vertical dismountable demarcations on each side. If the central armored wall is built permanently, meaning that it cannot be dismounted, into the turret, there will be a strut on the upper edge of the armored wall that divides the upper turret opening into two parts. In order for the storage rack in the middle to be installed from above in this case as well, the demarcations or walls of the middle storage rack and the inner wall of the outer storage rack will be set back at about half height so that the middle storage rack will first be retained somewhat farther out when it is installed from above until the point at which the inner wall is set back reaches the transverse strut and then shifted somewhat inward and lowered into their final position.

BRIEF DESCRIPTION OF THE DRAWINGS

FIG. 2 shows the situation once the outer storage rack has been installed,

FIG. 3 the situation when the inner storage rack has been half installed, and FIG. 4 the situation once the storage racks have been completely installed and mounted.

DETAILED DESCRIPTION OF THE INVENTION

Figure 1:
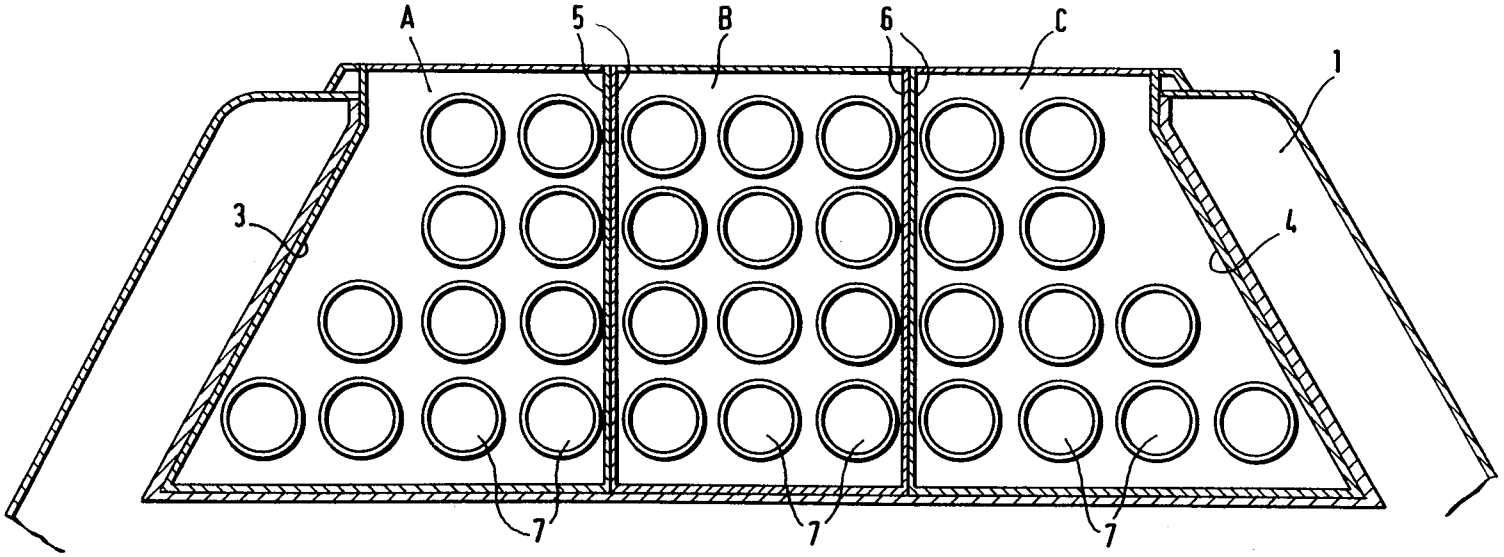
FIG. 1 is a cross-section through an ammunition-stowage system for an ammunition bunker in accordance with the invention that is divided into three storage racks.

In the ammunition-stowage system illustrated in FIG. 1, three storage racks A, B, and C, with storage tubes 7 for the ammunition, are located in the ammunition bunker of a tank turret 1. It will be immediately obvious that the ammunition-stowage system as a whole cannot be installed from above because of the sloping walls of turret 1. To allow them to be installed and still exploit the space to the fullest extent possible the two outer storage racks A and C are shaped so that their outsides 3 and 4 widen outwards in conformity with the slope of the walls of turret 1, whereas their insides 5 and 6 are vertical. This design makes it possible on the one hand to provide more tubes 7 for storing shells in the lower rows than in the upper rows while, on the other, the ammunition-stowage system can still be installed in turret 1 if the two outer storage racks A and C are first introduced through the opening and advanced outward until they arrive at their final position and storage rack B then introduced into the space between storage racks A and C. Walls 5 and 6 in this embodiment can be dismountable armored walls.

Figure 2:
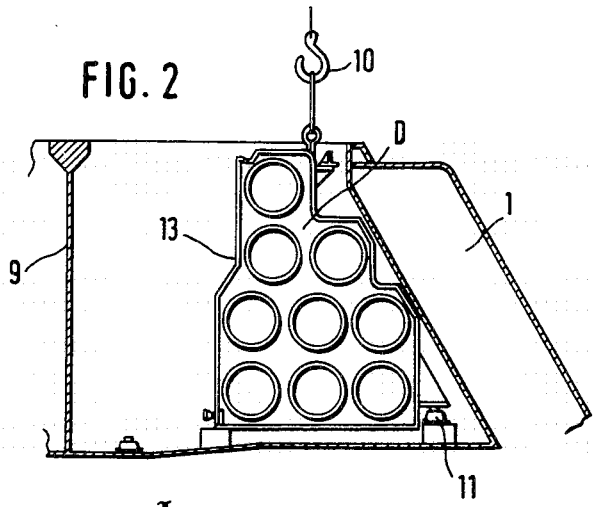
FIGS. 2, 3, and 4 concern an ammunition-stowage system that is divided into four racks, with only the right half of the stowage system being illustrated.
Figure 3:
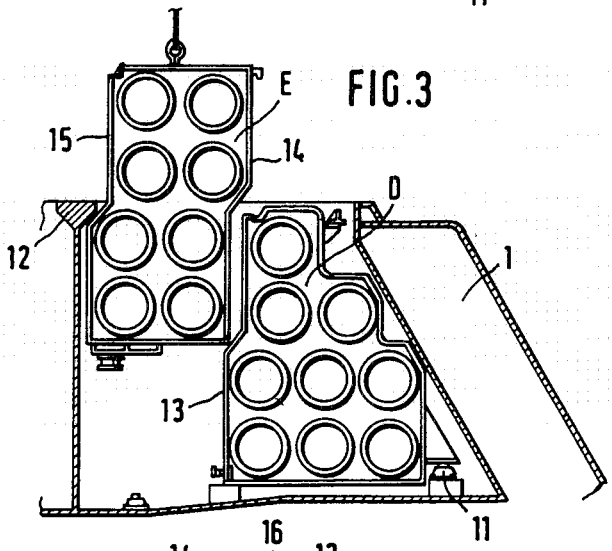
Figure 4:
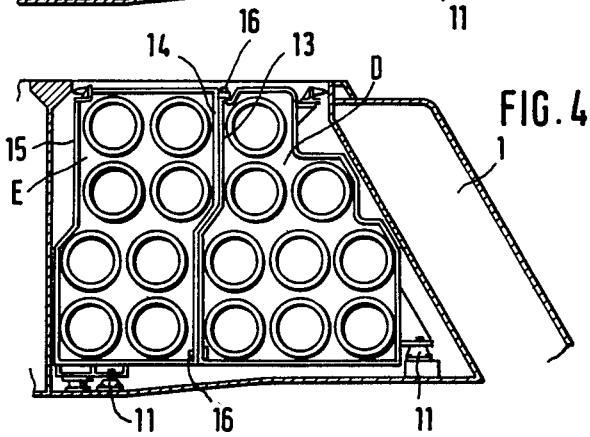

A frequent requirement is that the ammunition bunker be divided into two mutually independent parts by a permanent central armored wall. This embodiment is illustrated in FIGS. 2 through 4, with only the right half being shown.

Turret 1 is here divided by an armored wall 9 into two symmetrical chambers of equal size. The part of the ammunition-stowage system that is to be installed in the right chamber consists of storage racks D and E. As illustrated in FIG. 2, storage rack D is first lowered suspended from the hook 10 of a crane into the turret from above and, when it has arrived at its lowest position, shifted to the right, and hence toward the wall of the turret, until it arrives at its final position, in which it is secured with securing elements 11. Storage rack E is then lowered. A strut 12, which forms the upper end of armored plate 9, however, is in the way. Both the inside 13 of storage rack D and both sides 14 and 15 of storage rack E are accordingly set back at about half height, specifically to about half the width of strut 12. As will be evident from FIG. 3, storage rack E can now initially be lowered into a position in which the lower part of set-back wall 14 contacts or approximately contacts the upper part of set-back wall 13. Once storage rack E has been half lowered, it can, because of the setback on wall 15, be shifted more or less inward, to the left, that is, so that the lower part of wall 14 can slide along the lower part of wall 13, and the storage rack can be lowered until it arrives in the position illustrated in FIG. 4. Both storage racks can now be attached together with screws 16 and to the floor of the turret with elastic fasteners 11.

Walls 13, 14, and 15 and walls 5 and 6 in FIG. 1 can be made out of sheet metal or even armor plate but need not necessarily be continuous walls. It is also possible to have demarcations that are not continuous walls but only constitute boundary lines so that the storage racks will form a single ammunition-stowage system without intermediate separating walls when they are screwed together.

We claim:

1. In an ammunition-stowage system installable in an ammunition bunker of a tank turret having side walls that taper upwardly from a base to an upper opening which is narrower than the base and wherein the system has horizontal tubes for storing shells, the improvement wherein the turret has a transverse strut dividing the opening into two parts and wherein the system has outer sides which face the side walls of the bunker and slope upwardly to fully utilize the available space in the bunker and wherein the system comprises four storage racks holding said tubes and configured to be installed in the bunker one after another from above through the upper opening of the turret and to be positioned next to one another on both sides of the strut with two outer racks and two intermediate racks, wherein the storage racks are separated from one another at the sides that face one another subsequent to installation at vertical separating planes and include means for screwing the storage racks together at said separately planes, wherein the two outer racks have inner sides comprising vertical separating planes that are inwardly offset halfway up and outer sides forming the outer side of the system and sloping outwardly in conformity with the side walls of the bunker, and wherein the two intermediate racks have matching vertical separating planes at each side that are inwardly offset halfway up.

2. The ammunition-stowage system as in claim 1, wherein the sides of the storage racks comprise continuous sheet-metal walls.

3. The ammunition-stowage system as in claim 1, further comprising a vertical wall positioned between the two intermediate storage racks at the transverse strut.

* * * * *